United States Patent [19]

Corsetti

[11] Patent Number: 4,719,828

[45] Date of Patent: Jan. 19, 1988

[54] SCREW STARTER DEVICES

[76] Inventor: John A. Corsetti, 833 SW. Bayshore Blvd., Port St. Lucie, Fla. 33452

[21] Appl. No.: 323

[22] Filed: Jan. 5, 1987

[51] Int. Cl.[4] ..... B25B 23/08; B25B 23/10

[52] U.S. Cl. ..... 81/451; 81/452

[58] Field of Search ..... 81/451, 456, 458, 452, 81/454, 457, 125, 57.37, 431, 44, 333

[56] References Cited

U.S. PATENT DOCUMENTS

| | | | |
|---|---|---|---|
| 1,468,969 | 9/1923 | Lawlor | 81/454 |
| 3,633,640 | 1/1972 | Moore | 81/451 |
| 4,221,249 | 9/1980 | Mazzeo | 81/451 |

*Primary Examiner*—Robert P. Olszewski

*Assistant Examiner*—Bradley I. Vaught

*Attorney, Agent, or Firm*—Carroll F. Palmer

[57] ABSTRACT

A screw starter device for temporarily holding a screw while starting it into a substrate is a truncated conical rigid tubular member that tapers downwardly from its proximal end portion to the distal end portion. A first arcuate concentric opening in its side is defined by a first proximal transverse edge, a first distal transverse edge and a first pair of longitudinal edges and there is a second arcuate concentric opening similar to, but smaller than and distal of the first opening. A first longitudinal slot through the side of the member extends from the first opening to the second and a second longitudinal slot smaller in width than the first extends from the second opening to the distal end of the member.

8 Claims, 7 Drawing Figures

SCREW STARTER DEVICES

BACKGROUND OF THE INVENTION

1. Field of the Invention

This invention relates to screw starter devices for temporarily holding a screw while starting it into a substrate. Although intended primarily for use with wood screws, the new devices may be used for holding machine screws, bolts and other fasteners.

2. Description of the Prior Art

One serious difficulty in driving a screw into a panel or like substrate is getting it to start into the substrate and at the proper angle. This can be mitigated in several ways, e.g., by first drilling a pilot hole in the substrate or by the use of a variety of complex holding devices that have been developed for attachment to screw drivers and power drills. However, the drilling of pilot holes or the use of attachment devices is often impossible because of the lack of a drill or attachment device to a great number of homeowners, etc. whose occasional need to install screws does not justify the purchase of expensive drills and attachment devices.

Screw starting difficulties have been given serious attention in the past and several hand held tools have been developed to assist in solving the problem, e.g., see U.S. Pat. Nos. 3,316,949, Des. 272,230 and Des. 273,657. This invention provides further improvements in hand held tools to assist in the installing screws in substrates.

OBJECTS

A principal object of the invention is the provision of a new form of hand tool for use in driving screws.

Further objects include the provision of:

1. Screw starter devices for temporarily holding a screw while starting it into a substrate.
2. A form of hand held device to temporarily position and hold a screw while beginning to drive it into a substrate with a screw driver.

Other objects and further scope of applicability of the present invention will become apparent from the detailed description given hereinafter; it should be understood, however, that the detailed description, while indicating preferred embodiments of the invention, is given by way of illustration only, since various changes and modifications within the spirit and scope of the invention will become aparent to those skilled in the art from this detailed description.

SUMMARY OF THE INVENTION

The objects are accomplished, in part, in accordance with the invention by the provision of screw starter devices for temporarily holding a screw while starting it into a substrate which is in the form of a truncated conical rigid tubular member defined by a proximal end portion, a distal end portion and a central body portion integral with the end portions. The member tapers downwardly from the proximal end portion to the distal end portion.

There is a first arcuate concentric opening large enough to admit the head of a screw to be started into a substrate with the aid of the device in its side defined by a first proximal transverse edge, a first distal transverse edge and a first pair of longitudinal edges. There is also a second arcuate concentric opening smaller in size than the first opening and distal thereof in the side defined by a second proximal transverse edge, a second distal transverse edge and a second pair of longitudinal edges.

A first longitudinal slot large enough in width to admit the shank of a screw to be started into a substrate with the aid of the device extends through the side of the member extending from and through the first distal transverse edge to and through the second proximal transverse edge. Also, there is a second longitudinal slot smaller in width than the first slot through the side of the member extending from and through the second distal transverse edge to and through the distal end of the member.

The new device is used by inserting a screw therein with its head toward the proximal end and then holding the device in one hand while the screw is started into a substrate with a screw driver held in the other hand.

BRIEF DESCRIPTION OF THE DRAWINGS

A more complete understanding of the invention may be had by reference to the accompanying drawings in which.

DESCRIPTION OF THE PREFERRED EMBODIMENTS

Figure 1:
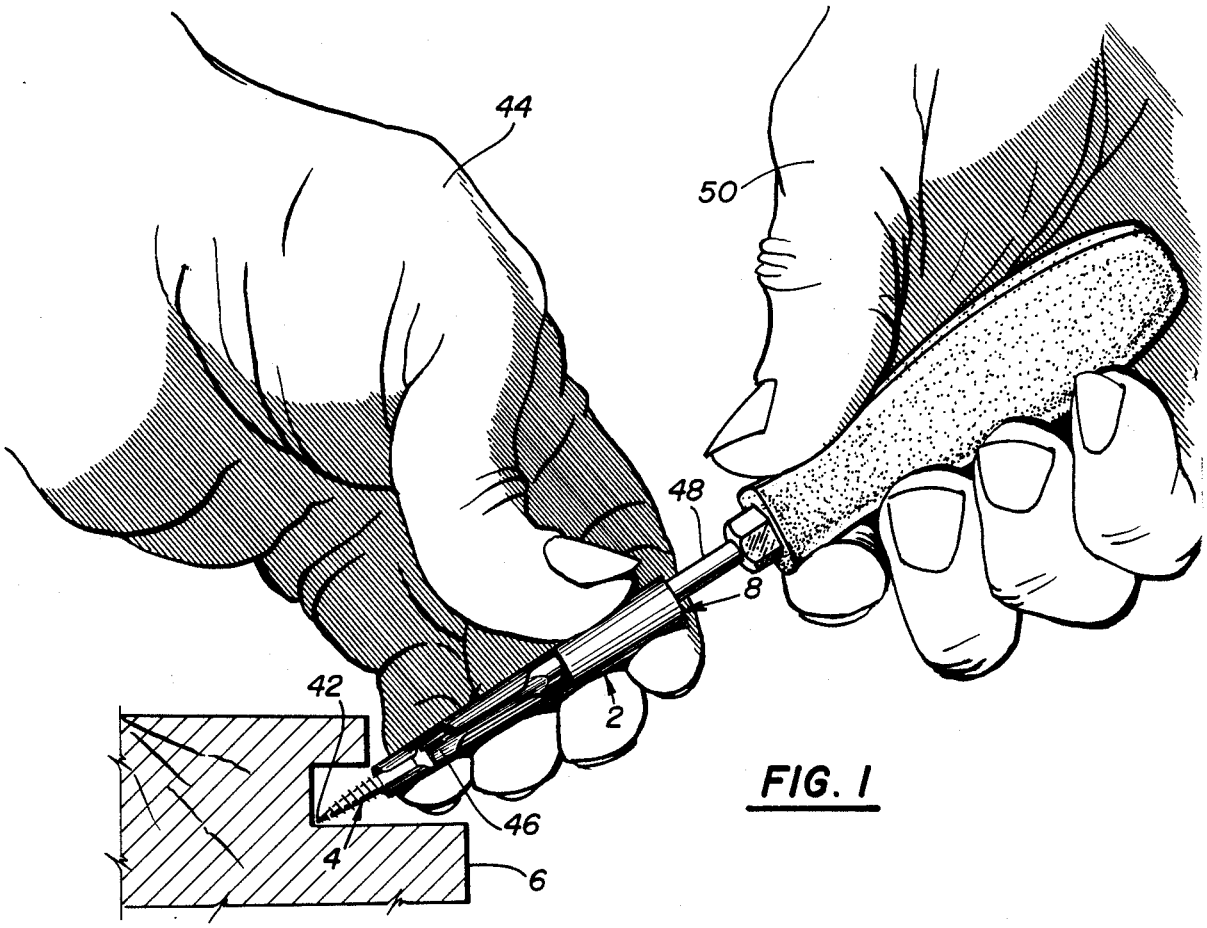
FIG. 1 is a perspective view of a screw starter device of the invention being used to start the driving of a screw into a substrate.
Figure 2:
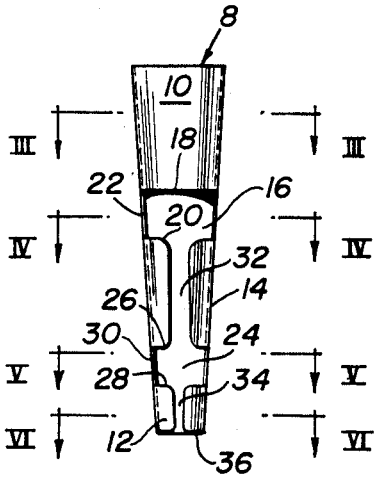
FIG. 2 is a lateral view of screw starter device of the invention.
Figure 3:
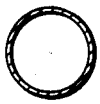
FIG. 3 is a sectional view taken on the line III—III of FIG. 2.
Figure 4:
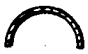
FIG. 4 is a sectional view taken on the line IV—IV of FIG. 2.
Figure 5:
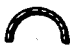
FIG. 5 is a sectional view taken on the line V—V of FIG. 2.
Figure 6:
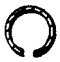
FIG. 6 is a sectional view taken on the line VI—VI of FIG. 2.

Referring in detail to the drawings, in which identical parts are identically marked, the invention concerns a screw starter device 2 for temporarily holding a screw 4 while starting it into a substrate 6.

The device 2 comprises a truncated conical flexible tubular member 8 defined by a proximal end portion 10, a distal end portion 12 and a central body portion 14 integral with the end portions.

A first arcuate concentric opening 16 large enough to admit the head of the screw 4 in the side of the member 8 is defined by a first proximal transverse edge 18, a first distal transverse edge 20 and a first pair of longitudinal edges 22. There is also a second arcuate concentric opening 24 defined by a second proximal transverse edge 26, a second distal transverse edge 28 and a second pair of longitudinal edges 30.

A first longitudinal slot 32 large enough in width to admit the shank of the screw 4 extends through the side of the member 8 from and through the first distal transverse edge 20 to and through the second proximal transverse edge 26. A second longitudinal slot 34 also is in the side of the member 8 extending from and through the second distal transverse edge 28 to and through the distal end 36 of the member 8.

In a preferred embodiment of the invention, the device 2 is between about 2 to 4 inches in length, the diameter of the proximal end thereof is between about ¼ and 1 inch, the diameter of the distal end thereof is between about ⅛ and ½ inch and it has a wall thickness 38 of between about 1/50 and ¼ inch. The device 2 can be made of metal or plastic.

Figure 7:
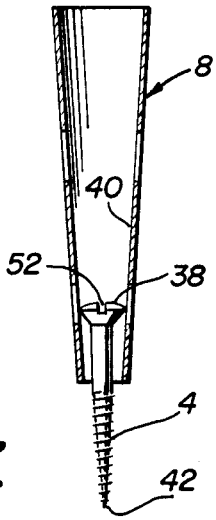
FIG. 7 is a lateral sectional view of a screw starter device of the invention with a screw positioned therein for driving into a substrate.

FIG. 1 illustrates the use of the new devices 2 to get the screw 4 started and at the correct angle into the substrate 6. First, the screw 4 is inserted into the member 8 so its head 38 is supported by the inside wall 40 of the member 8 and with it point 42 extending out the distal end 36 as shown in FIG. 7. Then, the member 8 with the enclosed screw 4 is grasped in one hand 44 and moved so the screw point 42 contacts the substrate 6 at the proper location. The member 8 is held in the hand 44 at the angle that the screw 4 is to be driven into the substrate 6, usually perpendicular thereto. Next, the end 46 of the screw driver 48 held in hand 50 is inserted in the slot 52 of screw 4 and it is manipulated by the driver 48 until it has been driven part way into substrate 6. At that point, member 8 is removed from the partially driven screw 4 by slipping the screw head 38 through opening 16 or 24, depending on the size of the screw, and one or both slots 32 & 36. Since the thickness 38 of the member 8 is relatively thin, the member 8 is capable of flexing along the slots 32 & 36, if necessary, to allow the shank of the screw 4 to pass through.

The embodiments of the invention in which an exclusive property or privilege is claimed are defined as follows:

1. A screw starter device for temporarily holding a screw while starting it into a substrate which comprises:

a truncated conical flexible tubular member defined by a proximal end portion, a distal end portion and a central body portion integral with said end portions, said member tapering downwardly from said proximal end portion to said distal end portion, a first arcuate concentric opening large enough to admit the head of a screw to be started into a substrate with the aid of a device in said side of said tubular member defined by a first proximal transverse edge, a first distal transverse edge and a first pair of longitudinal edges, a second arcuate concentric opening smaller in size than said first opening in said side of said tubular member distal of said first opening defined by a second proximal transverse edge, a second distal transverse edge and a second pair of longitudinal edges, a first longitudinal slot large enough in width to admit the shank of a screw to be started into a substrate with the aid of said device through the side of said member extending from and through said first distal transverse edge to and through said second proximal transverse edge, and a second longitudinal slot smaller in width than said first slot through the side of said member extending from and through said second distal transverse edge to and through the distal end of said member.

2. The device of claim 1 which is between about 2 to 4 inches in length.

3. The device of claim 1 wherein the diameter of the proximal end thereof is between about ¼ and 1 inch.

4. The device of claim 3 wherein the diameter of the distal end thereof is between about ⅛ and ½ inch.

5. The device of claim 1 wherein said member has a wall thickness of between about 1/50 and ¼ inch.

6. The device of claim 5 wherein said member is made of metal.

7. The device of claim 5 wherein said member is made of plastic.

8. The device of claim 1 wherein said first and second slots approximate arcuate rectangles.

* * * * *